United States Patent [19]

Coar

[11] 4,218,833

[45] Aug. 26, 1980

[54] FLOAT TREATMENT APPARATUS

[75] Inventor: Ronald Coar, Ilkley, England

[73] Assignee: Spooner Edmeston Engineering Limited, Ilkley, England

[21] Appl. No.: 6,768

[22] Filed: Jan. 26, 1979

[30] Foreign Application Priority Data

Jan. 27, 1978 [GB] United Kingdom ..... 3312/78

[51] Int. Cl.[2] ..... F26B 13/20

[52] U.S. Cl. ..... 34/156; 226/97; 414/676

[58] Field of Search ..... 226/7, 97; 34/156, 155; 414/676

[56] References Cited

U.S. PATENT DOCUMENTS

| | | | |
|---|---|---|---|
| 3,485,429 | 12/1969 | Hutzenlaub | 34/156 |
| 3,668,788 | 6/1972 | Kobayashi | 34/156 |
| 3,982,328 | 9/1976 | Gustafsson et al. | 34/156 |
| 4,058,244 | 11/1977 | Vits | 34/156 |

*Primary Examiner*—Larry I. Schwartz
*Attorney, Agent, or Firm*—Fred Philpitt

[57] ABSTRACT

An air cylinder for supporting a moving web of material during heat treatment, particularly during drying, of such web. The cylinder comprises a plurality of nozzles which are arranged in a part-circular array around which the moving web passes, the nozzles being of the Coanda type wherein the discharge gaseous medium flows over a transversely extended lip surface of the nozzle between the extended surface and the adjacent surface of a web being treated and is caused to cling to such extended surface by the so-called Coanda effect.

In order to support the moving web particularly stably in the radial direction relative to the cylinder, the nozzles are arranged in pairs, with the respective transversely extended surfaces of the two nozzles in each pair extending in opposite directions whereby air flowing over these two extended surfaces flows in opposite circumferential directions to respective radially inwardly directed air outlets. Each air outlet commonly serves two nozzles, one from each of two adjacent pairs of nozzles, respectively.

A plurality of the part-circular arrays of Coanda nozzles can be disposed with adjacent arrays inverted in relation to each other so as to support the material web in a circuitous path around such arrays.

5 Claims, 6 Drawing Figures

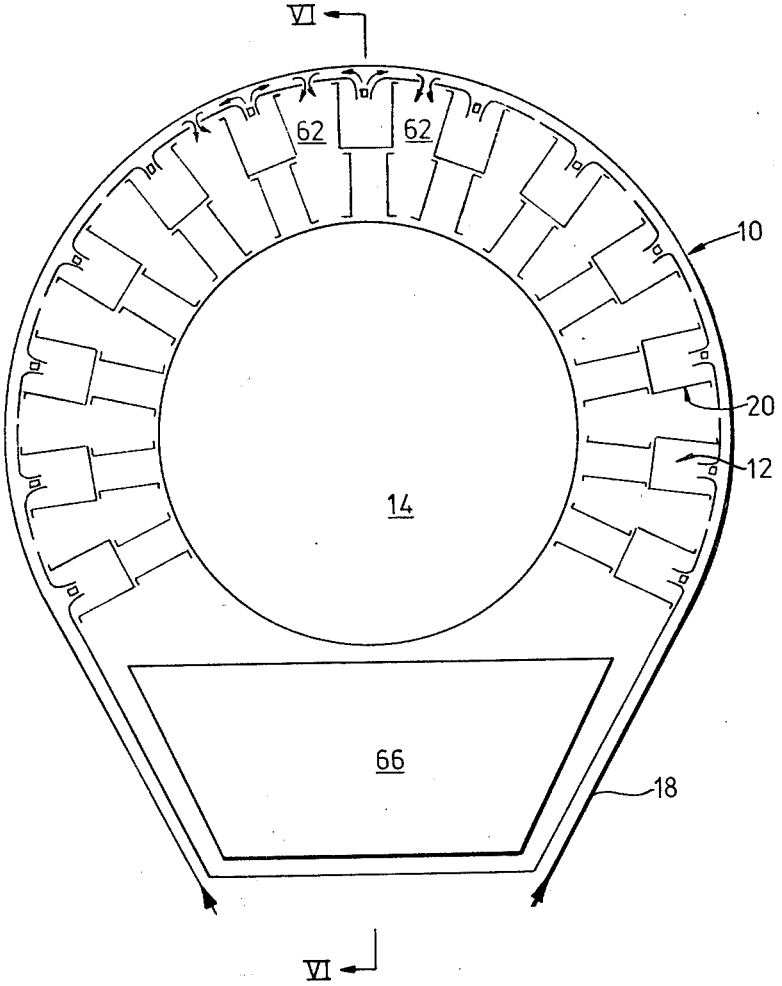
—FIG.1—

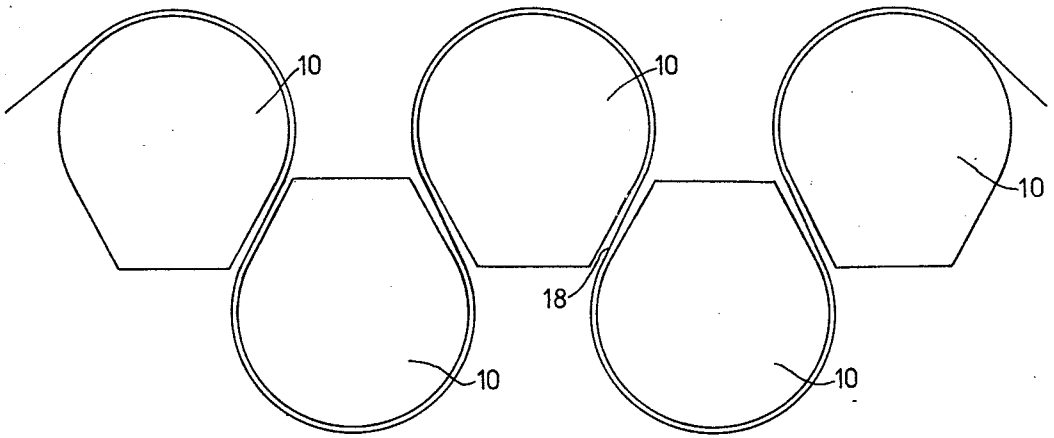
—FIG. 2.—

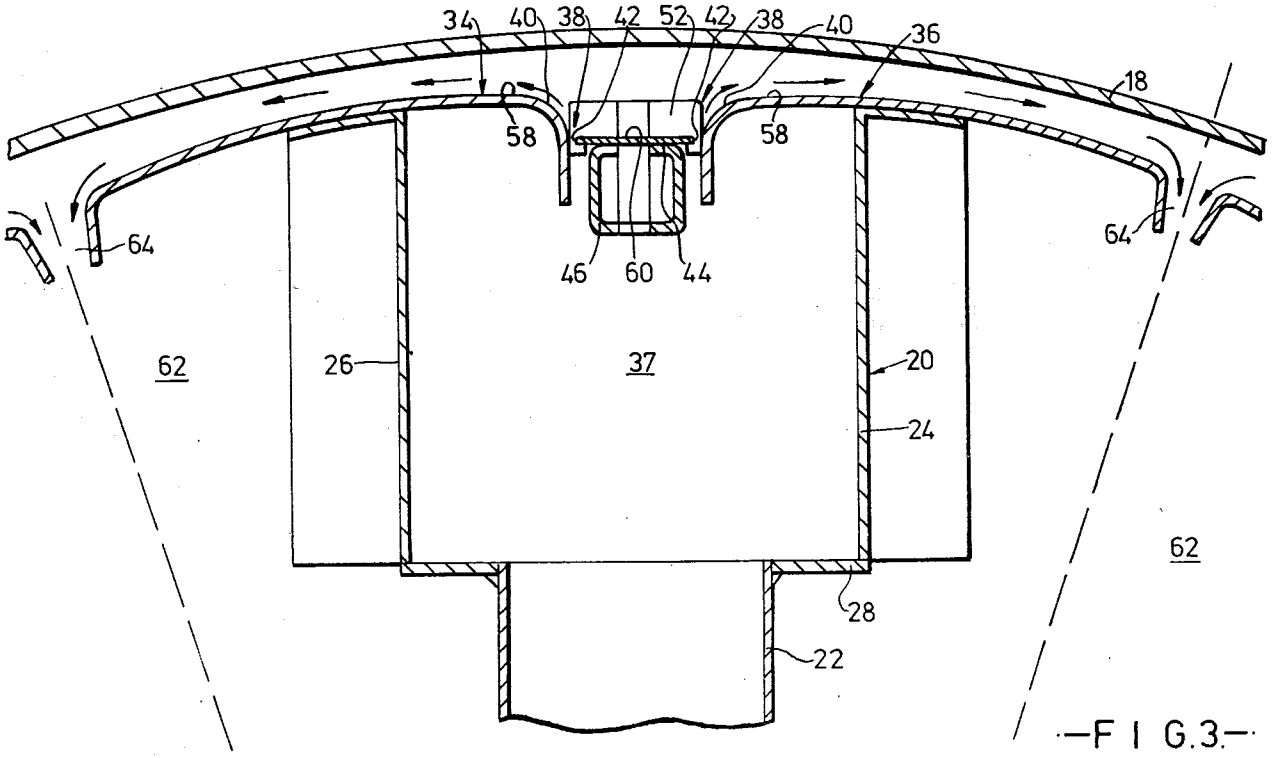
—FIG. 3—

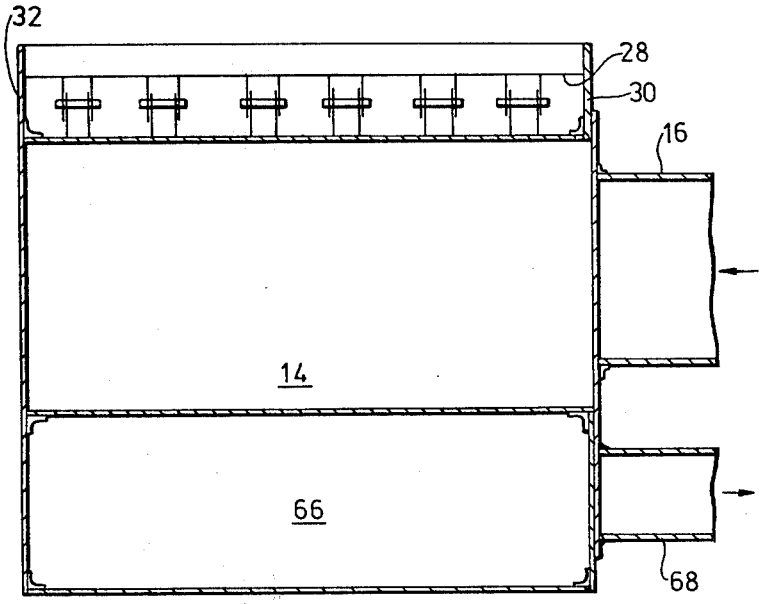
—FIG.6—

FLOAT TREATMENT APPARATUS

DESCRIPTION

The present invention relates to float treatment apparatus for treating a floating web of material and is particularly concerned with such apparatus for use in drying continuously formed material webs, such as paper.

For the past 150 years or so paper production has involved the passage of a continuously formed wet paper web around rotating cast iron, steam heated drying cylinders to drive at least some of the moisture from the web. It has long been realised that the use of these cylinders results in many practical disadvantages. In order to achieve reasonable drying efficiency they have to be of massive size so that correspondly massive supporting framework, bearings and driving gears are necessary. The apparatus thus occupies considerable floor space. The use of such cylinders normally requires the additional use of felts or other fabric webs to hold the paper web in close contact with the cylinders, the latter felts or fabrics requiring periodic, expensive replacement and an additional plurality of rollers to guide them around the cylinders. The use of such cylinders also requires the provision of a relatively complicated and expensive ventilation system in order to maintain uniform air conditions around the cylinders to achieve even approximately uniform drying conditions. However, in practice it has been found to be impossible to obtain truly uniform drying using the traditional cylinders.

Attempts have been made to replace individual cast iron cylinders with air cylinders (see for example U.S. Pat. No. 3,279,091) which comprise a plurality of air nozzles arranged in a part cylindrical array whereby a web supported by pressurized air from the nozzles assumes a corresponding part cylindrical formation in passing therearound. Such air nozzles have comprised elongate slots extending in parallel longitudinal directions along the surface of hollow part cylindrical hollow shells.

The main problem with such air-cylinders has been, however, that in order to maintain a workable air cushion for the moving web, impossibly fine tension control is required since a balance has to be continuously maintained between the radially outwardly acting forces on the web arising from the air jets impinging thereon and the radially inwardly acting forces arising as a result of the tension in the web established by means of separately controlled input and output drive nips disposed upstream and downstream of the cylinder, respectively. Furthermore, such known air cylinders have been subject to unsolved problems resulting from the variable rate of web shrinkage which is often incurred.

It is an objective of the present invention to provide an air cylinder in which the previous requirement for fine tension control is obviated and which can operate efficiently in a multi-cylinder arrangement.

The present invention makes use of so-called Coanda nozzles, the basic principle of which has been known in the art for some time. A Coanda nozzle is one in which the discharged gaseous medium, normally air, flows over a laterally extended curved lip surface of the nozzle between that extended surface and the adjacent surface of the web being treated, the discharged gaseous medium being caused to cling to such extended surface by the so-called Coanda effect. Provided that dimensions and pressures are suitably chosen, the web of material will flow stably on the nozzle at a small distance from the extended surface. The present invention is, however, not concerned with the theory of operation of such nozzles which has been well documented elsewhere (see for example U.K. Pat. No. 1,302,091) but with the use of such nozzles in an arrangement which provides an advantageous operating performance.

In accordance with the present invention, a plurality of Coanda nozzles are arranged in a curved array whereby a web supported by the nozzles assumes a correspondingly curved configuration. Preferably, the nozzles are arranged in a part-circular array, there being a plurality of such part-circular arrays disposed with adjacent arrays inverted in relation to each other so as to support the material web in a circuitous path around such arrays.

The use of Coanda nozzles in this manner has the result that, rather than being merely loosely supported in the radial direction as in the case of the known air cylinders, the moving web is positively held to the contour of the cylinder by virtue of the air flow pattern achieved. As a result, very wide variations in tension in the web can be accepted from substantially zero to approaching web breakage whereby the mechanical running problems encountered with the known arrangements are eliminated.

Since drying of the web by means of a uniformly distributed film of hot air can now be achieved, advantages are obtained in that:

(a) Drying is absolutely uniform.

(b) The moist air can be exhausted from the cylinder by means of a standard exhaust duct so that only the moisture leaving the sheet from its back side remote from the nozzles may need a simple canopy to remove it.

(c) One is no longer restricted to steam heating; forms of heating other than steam can enable much higher temperatures to be used and hence much higher evaporation rates to be obtained.

(d) No fabrics are required to guide the web around the cylinder and the vapour escapes from both sides of the sheet, resulting again in higher evaporation rates.

Preferably, the nozzles are arranged in pairs, with the respective transversely extended surface of the two nozzles in each pair extending in opposite directions whereby air flowing over these two extending surfaces flows in opposite circumferential directions to respective radially inwardly directed air outlets. Advantageously, each air outlet can then commonly serve two nozzles, one from each of two adjacent pairs of nozzles, respectively. This arrangement has been found to result in a particular efficient air flow pattern over the cylinder which holds the moving web stably in the radial and longitudinal directions relative to the cylinder while enabling the web to be drawn in a substantially frictionless manner around the cylinder.

Obviously, for drying purposes, the air supplied by the nozzles is pre-heated, for example by gas burners.

The invention is described further hereinafter, by way of example, with reference to the accompanying drawings in which:

FIG. 1 is a diagrammatic vertical section through one embodiment of a float treatment apparatus constructed in accordance with the present invention;

FIG. 2 is a diagrammatic illustration of a plurality of part cylindrical arrays in accordance with the invention arranged for transporting a material web;

FIG. 3 is a diagrammatic section through one of a plurality of nozzle units which together make up part of the cylinder of FIG. 1;

FIG. 6 is a section on the line VI—VI of FIG. 1, to a reduced scale.

Figure 5:
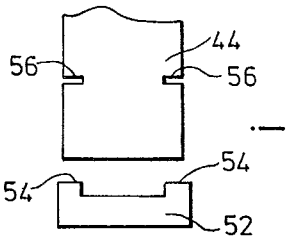
FIG. 5 is a partial view showing further portions of the nozzle unit of FIG. 3.

The cylinder 10 of FIG. 1 comprises a plurality, thirteen in this instance, of individual nozzle units 12 disposed in a part circular array, the nozzle units 12 each being constructed as shown in more detail in FIG. 3. The radially inner ends of the nozzle units 12 communicate with a cylindrical central chamber 14 connected via pipework 16 (see FIG. 6) to a heated pressure medium supply (not shown) which would normally be hot air, the air exiting from the radially outer ends of the nozzle units being such as to be capable of supporting and guiding around the cylinder a travelling web 18, as shown in FIG. 1.

Figure 4:
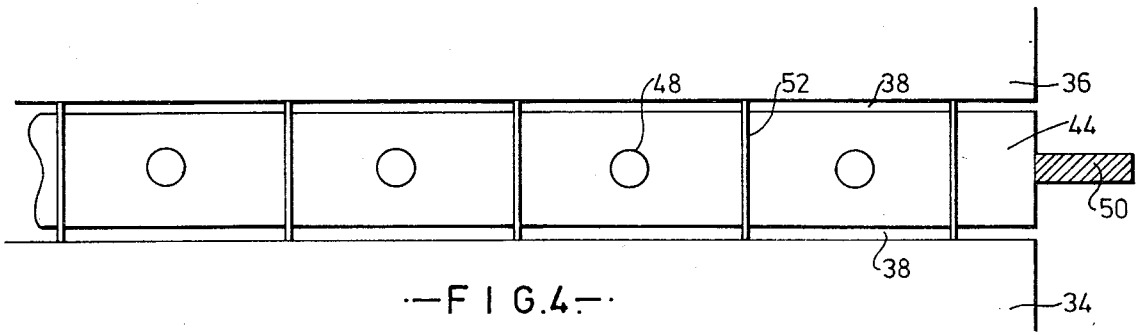
FIG. 4 is a partial plan view of a portion of the nozzle unit of FIG. 3.

With reference to FIGS. 3, 4 and 5, each nozzle unit 12 comprises a nozzle box 20 communicating at its radially inner end with the chamber 14 by way of a radially extending pipe 22. The box 20 is formed by a pair of longitudinal side walls 24,26 formed from sheet metal, a base wall 28 having a plurality of cylindrical openings which receive the pipes 22 (see FIG. 6), closed end walls 30,32 and a top wall defined principally by a pair of profiled sheet metal members 34,36. By virtue of its connection to the inner cylindrical chamber 14, each box defines a pressure chamber 37 which receives heated pressure medium (air) from the chamber 14, the box discharging the pressure medium through a pair of nozzle slots 38.

The outer lips of the slots 38, i.e. the lips remote from one another, are defined by rounded surfaces 40 on the profiled sheet metal members 34,36. The inner lips are defined by lateral edges 42 of a medial plate 44 which is supported in position between the outer lips by means of a box sectioned tube 46 to which the plate 44 is rigidly attached, for example by a plurality of rivets 48 (FIG. 4). The box sectioned tube is itself mounted by means of longitudinally projecting pegs 50 at its two ends which are received in suitable guides (not shown) in a main framework of the cylinder. Transversely orientated spacer plates 52 are disposed at intervals along the plate 44, each spacer 52 having projections 54 which engage in respective slots 56 in the plate 44 whereby to maintain the width of the slots 38 at a predetermined constant width over their whole length. It will be appreciated that the aforegoing assembly permits simple disassembly to enable access to the interiors of the boxes 20 for cleaning purposes.

The rounded surfaces 40 blend with the substantially flat outer surfaces 58 of the profiled plates 34,36. The surfaces 58 are arranged to stand proud of a flat outer surface 60 of the medial plate 44 and the rounded surfaces 40 are likewise substantially proud of the flat surface 60. The pressure in the chamber 37, the width of the nozzle slots 38 and the radius of the rounded surfaces 40 are so chosen that gaseous medium discharged from the nozzles slots 38 tends to follow the rounded surfaces 40 and flow over the outer surfaces 58 in accordance with the Coanda effect, as shown by arrows in FIG. 1. The spent gaseous medium flows away into exhaust chambers 62, located between adjacent nozzle unit 12, by way of slots or apertures 64 formed between the adjacent profiled sheet metal members 34,35 of adjacent nozzle units. The spent gaseous medium passes to a common chamber 66 at the bottom of the cylinder which communicates with discharge pipework 68 (FIG. 6).

The theory of the manner in which the web 18 is supported will not be given inasmuch as the invention is not concerned with the theory but with the construction of the apparatus. Suffice it to say that, due to the Coanda effect, the discharged gaseous material leaving the nozzles 38 is caused to cling to the contour of the outer surfaces of the members 34,36 whereby the web 18 is supported relatively stably above each nozzle unit at a short distance above the surfaces 58. Due to the arrangement of the nozzle units to form a partial cylinder shown in FIG. 1, the web 18 is continually supported on a cushion of pressure medium in passing over the cylinder so that it is maintained at a substantially constant distance from the cylinder at all times. Furthermore, the hot pressure medium applied to the underside of the web serves to dry the web whereby the air cylinder acts as a float drier. If desired, drying can be assisted by the provision of an outer convected air drier of conventional construction which can be mounted around the cylinder opposite the outer side of the web. Such a drier could be in the form of an air cap or accelerator hood whereby to increase the evaporation rate from the web.

The aforegoing cylinder can be used in place of conventional rotating cast iron cylinders used, for example, in paper machines and for drying textiles and indeed for heating or cooling any web material. When used in place of known flat float drying apparatus, it will be appreciated that considerable floor space can be saved by the cylindrical nature of the present arrangement. FIG. 2 illustrates one possible arrangement which maximises the length of web which can be treated while minimising floor space utlisation wherein the tab 18 is passed around a plurality of cylinders 10, alternate ones of which are inverted whereby the web extends substantially tangentially between adjacent cylinders.

Additional advantages of the present construction over the known cast iron cylinders used for web drying, e.g. in paper machines, are as follows.

The web can shrink freely in the longitudinal direction and all that is required is a constant tension means to relate the speed of additional rolls, e.g. S wrap rolls, contact rolls or calender rolls, to the speed of the web.

The or each cylinder can be supplied with hot air heated directly by gas or any other appropriate heating medium, providing temperatures of up to say 600° F.

No fabrics or felts are required to support the web in its passage over the or each cylinder 10.

Maintainance problems can be expected to be reduced due to the few number of moving parts.

Less breakages in the web during its passage through the drier can be expected due to the web being completely free to shrink in the longitudinal direction.

With the arrangement as illustrated in FIG. 2, for example, the draws between adjacent cylinders can be much shorter than usual and the web can be substantially wholly enclosed between the cylinders. These factors assist when working with very high speed, lightweight webs.

Besides use in connection with paper drying, the present cylinders can also be used for heating or cooling plastics webs or films or drying textiles.

I claim:

1. A float treatment apparatus for drying a paper with gas comprising (a) a plurality of separate but adjacent nozzle arrays, each nozzle array comprising a plurality of nozzle pairs disposed in generally U-shaped curved arcs that have a curvature approximating at least half of a circle, adjacent nozzle arrays being U-shaped in opposite directions and being arranged and positioned with respect to each other so that a paper web passing thereover will move in a serpentine path that takes it around a more than 180° circumferential portion of an array, (b) each nozzle pair in each array being of the Coanda type and having lip surfaces extending in opposite directions from the point where gas exits through each nozzle pair, whereby the gas exiting from each nozzle pair flows in opposite circumferential directions, and (c) a plurality of gas outlets, each outlet being located between the outer lip edges of adjacent nozzles pairs said outlets extending radially inwardly and being adapted to receive the streams of gas flowing toward each other over the lip surfaces of adjacent nozzle pairs.

2. A float treatment apparatus according to claim 1 wherein each nozzle pair is connected to a separate nozzle box which feeds gas to that nozzle pair and the nozzle boxes are in turn coupled to a common distribution chamber disposed radially inwardly of the nozzle boxes and which is connected to pressurized air supply via an air inlet duct.

3. A float treatment apparatus according to claim 1 wherein each nozzle pair is formed by a pair of uniformly circumferentially spaced profiled sheet members, which define said transversely extended surfaces of the nozzles, and a medial plate each of whose two lateral side edges is uniformly spaced from a respective one of the profiled sheet members whereby to define a uniform slot therebetween.

4. A float treatment apparatus according to claim 3 including a plurality of radially directed spacer plates disposed at intervals along the length of the medial plate to maintain uniform said slots between the medial plate and the adjacent profiled sheet members.

5. A float treatment apparatus according to claim 4 including a supporting beam to which the medial plate is rigidly attached and which is removably mounted in an associated nozzle box to enable easy access to the nozzle box interior for cleaning purposes.

* * * * *